US008133137B2

(12) United States Patent
Grant et al.

(10) Patent No.: US 8,133,137 B2
(45) Date of Patent: Mar. 13, 2012

(54) PITCHING MACHINE HAVING OPTIMAL ADJUSTABILITY

(75) Inventors: Eugene Grant, Reno, NV (US); William R. Woessner, Chicago, IL (US); Ian Fettes, June Lake, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 43 days.

(21) Appl. No.: 12/386,019

(22) Filed: Apr. 14, 2009

(65) Prior Publication Data

US 2009/0260611 A1 Oct. 22, 2009

Related U.S. Application Data

(60) Provisional application No. 61/124,370, filed on Apr. 16, 2008.

(51) Int. Cl.
*A63B 69/00* (2006.01)
*F41B 15/00* (2006.01)
*F41B 4/00* (2006.01)

(52) U.S. Cl. ..... 473/451; 473/422; 473/431; 124/78; 124/6

(58) Field of Classification Search ..... 473/422, 473/451, 431; 124/78
See application file for complete search history.

(56) References Cited

U.S. PATENT DOCUMENTS

| | | | | |
|---|---|---|---|---|
| 4,632,088 | A | 12/1986 | Bruce | 124/78 |
| 4,676,504 | A | 6/1987 | Ponza | 124/7 |
| 4,823,763 | A | 4/1989 | Ponza | 124/78 |
| 4,890,834 | A | 1/1990 | Ponza | 473/421 |
| D356,842 | S | 3/1995 | Trapp | D21/720 |
| 5,832,909 | A | 11/1998 | Grant et al. | 124/6 |
| 5,865,161 | A | 2/1999 | Bruce | 124/78 |
| 6,093,117 | A | 7/2000 | Sherlock et al. | 473/422 |
| 6,190,271 | B1 | 2/2001 | Rappaport et al. | 473/451 |
| 6,202,636 | B1 | 3/2001 | O'Brien | 124/71 |
| 6,237,583 | B1 | 5/2001 | Ripley et al. | 124/78 |
| 6,401,704 | B1 | 6/2002 | Caldwell | 124/78 |
| 6,427,675 | B1 | 8/2002 | Caldwell et al. | 124/78 |
| 6,440,013 | B1 | 8/2002 | Brown | 473/422 |
| 6,443,859 | B1 | 9/2002 | Markin | 473/451 |
| 6,637,422 | B2 | 10/2003 | Wojtkiewicz et al. | 124/78 |
| 6,672,297 | B1 | 1/2004 | Liao | 124/6 |
| 6,732,724 | B1 | 5/2004 | Paulson et al. | 124/6 |
| 6,739,325 | B1 | 5/2004 | Paulson | 124/78 |

*Primary Examiner* — Mitra Aryanpour

(74) *Attorney, Agent, or Firm* — Terence P. O'Brien

(57) ABSTRACT

A pitching machine configured for adjustment by a user, and including a pitching head, a first macro-adjustment device and a first micro-adjustment device. The pitching head is situated atop a stand. The pitching head includes a first wheel spaced apart from an opposing surface and a first motor for driving the first wheel. The first macro-adjustment device is coupled to the pitching head and includes a first locking assembly that, when loosened, allows manual rotation of the pitching head about a first pivot axis. The first micro-adjustment device is coupled to the pitching head, and includes a first adjusting element that, when repositioned, incrementally rotates the pitching head about the first pivot axis. The first micro-adjustment device configured for operation by a single hand of a user, and the first macro-adjustment device retaining the pitching head in a secure position during adjustment of the first micro-adjustment device.

22 Claims, 12 Drawing Sheets

FIG. 5
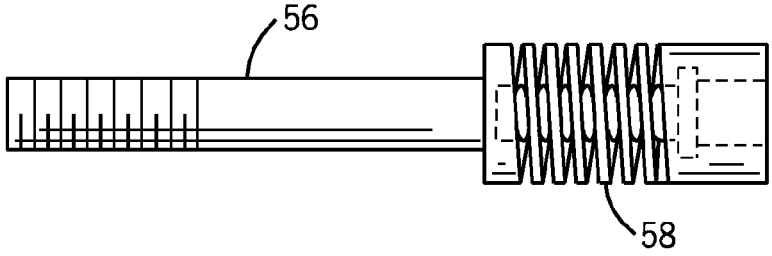
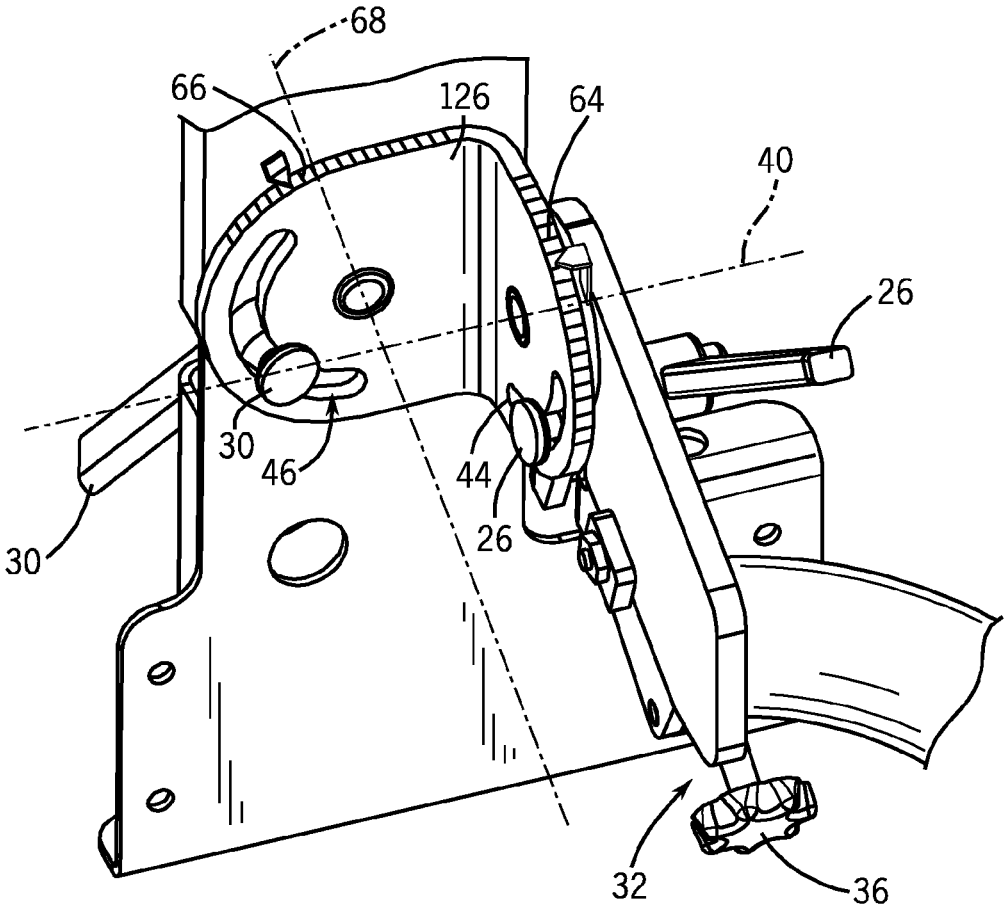
FIG. 6

FIG. 13
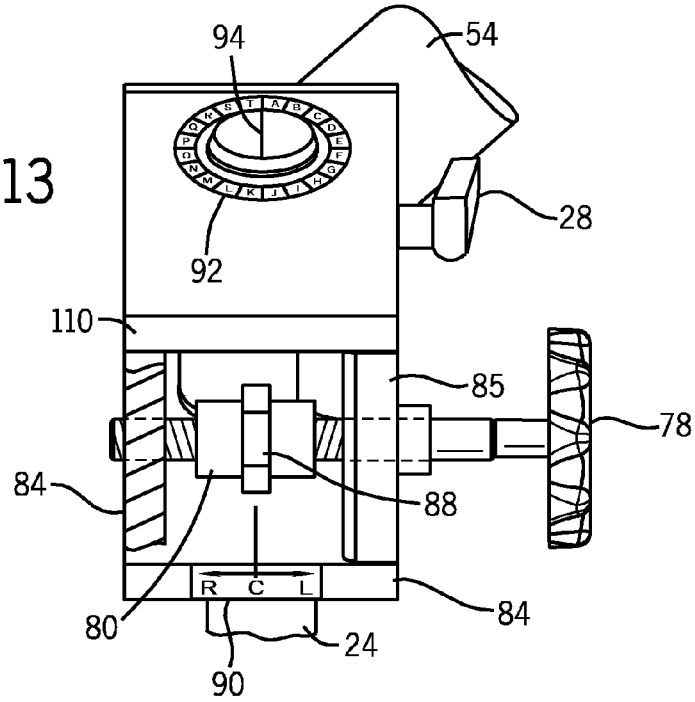
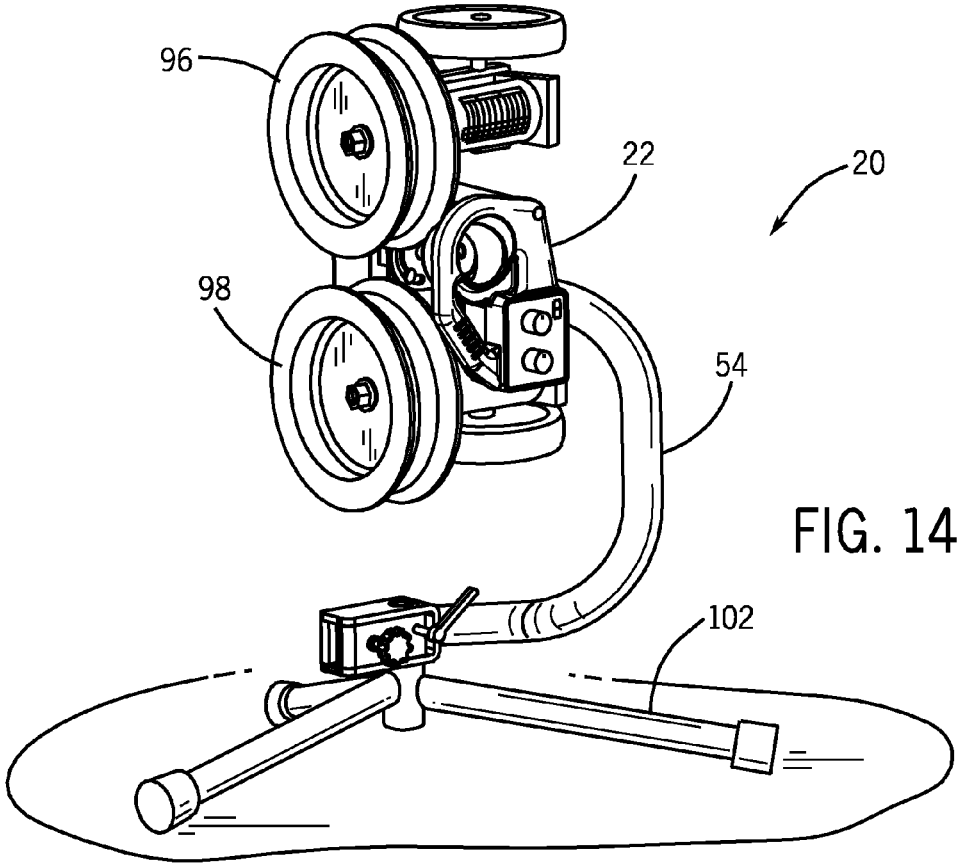
FIG. 14

PITCHING MACHINE HAVING OPTIMAL ADJUSTABILITY

RELATED U.S. APPLICATION DATA

The present invention claims the benefit of the filing date under 35 U.S.C. §119(e) of U.S. Provisional Patent Application Ser. No. 61/124,370, filed on Apr. 16, 2008, which is hereby incorporated by reference in its entirety.

FIELD OF THE INVENTION

The present invention relates to a pitching machine having a micro-adjustment features.

BACKGROUND OF THE INVENTION

Pitching machines are widely used by both professional and non-professional athletes for batting practice. Conventional pitching machines include a pitching head having either one motor driven wheel or two counter-rotating motor driven wheels that engage a ball and project the ball toward an awaiting batter. These machines often include macro-adjustment capabilities for altering the pitch location. Such macro-adjustments are typically achieved by loosening locking handles and then moving the machine head, by hand, about one or more axes to position the head to throw the type of pitch (spin angle) to the desired location. The user sets the head at about the position they think they want, locks it into position, and then turns the machine on to throw test pitches.

After one or more test pitches, the user typically needs to fine-tune the pitch location by making minor adjustments to move the pitch to the left or right or up or down, namely "micro-adjustments." To perform micro-adjustments on conventional pitching machines, the user must again loosen the same locking handles and, ever so slightly, move the head to where the user estimates is the correct position and, once again, locks the head into place. Usually this micro-adjustment process requires numerous tries of locking and unlocking until the machine is throwing to the desired location.

Pitching machines are generally quite heavy with much of the machine's weight residing in the pitching head elevated above the ground typically by a stand. This generally top heavy design further increases the difficulty of performing multiple small adjustments of the pitching head to achieve the desired pitch location. Some pitching machines require two users to adjust the position of the machine. In other cases, a single user must use both hands and be positioned properly to manipulate locking handles and retain the pitching head in the desired location during the adjustment. If one fails to properly hold or maintain the pitching head during minor adjustments, the top heavy design of the pitching head can cause the pitching head to suddenly drop or slide to a lower position. In some instances, the sliding or dropping of a pitching head can cause the pitching machine to tip over.

It would thus be desirable to provide a pitching machine that is capable of performing micro-adjustments efficiently and easily. What is needed is a pitching machine that allows for minor adjustments without requiring two people, or one person using two hands to adjust the machine. It would be advantageous to provide a pitching machine that does not create the risk of sudden movement of the pitching head if the user loses hold of the pitching head during minor adjustments.

SUMMARY OF THE INVENTION

The present invention presents a pitching machine for use with balls, such as baseballs and softballs. The pitching machine features a micro-adjustment capability that allows a user to easily fine-tune the pitch location.

The present invention provides a pitching machine configured for adjustment by a user, includes a pitching head, a first macro-adjustment device and a first micro-adjustment device. The pitching head is situated atop a stand. The pitching head includes a first wheel spaced apart from an opposing surface and a first motor for driving the first wheel. The first macro-adjustment device is coupled to the pitching head and includes a first locking assembly that, when loosened, allows manual rotation of the pitching head about a first pivot axis. The first micro-adjustment device is coupled to the pitching head, and includes a first adjusting element that, when repositioned, incrementally rotates the pitching head about the first pivot axis. The first micro-adjustment device configured for operation by a single hand of a user, and the first macro-adjustment device retaining the pitching head in a secure position during adjustment of the first micro-adjustment device.

According to a principal aspect of a preferred form of the invention, a pitching machine is configured for adjustment by a user and includes a pitching head situated atop a stand, a first macro-adjustment device, and a first micro-adjustment device. The pitching head includes a first wheel spaced apart from an opposing surface by a distance slightly less than a diameter of a ball, and a first motor for driving the first wheel. The first macro-adjustment device is coupled to the pitching head configured for adjustable manual rotation of the pitching head about a first pivot axis. The first micro-adjustment device is coupled to the pitching head, and includes a first adjusting element that, when repositioned, incrementally rotates the pitching head about the first pivot axis, and a first reverse-threaded spindle coupled to the pitching head.

In this embodiment, the pitching machine further includes a horizontal-pivot micro-adjustment device, which includes a knob operatively attached to a reverse-threaded spindle that, when turned, incrementally rotates the pitching head about the vertical pivot axis. The horizontal-pivot micro-adjustment device enables a user to fine-tune the pitch location merely by turning the knob, rather than having to manually unlock the head, reposition the head, and lock the head back into place. The reverse-threaded spindle may include an indicator in the center to indicate how much further the micro-adjustment knob may be turned in either direction. The horizontal-pivot micro-adjustment device may have a range up to about 24 inches, or up to about 18 inches.

In yet another preferred embodiment, the pitching machine includes a pitching head situated atop a stand, with the pitching head including a first wheel spaced apart from an opposing surface by a distance roughly equal to a diameter of a ball, and a motor that drives the first wheel. The pitching machine also includes a vertical-pivot macro-adjustment device, which includes a locking device that, when loosened, allows manual rotation of the pitching head about a first horizontal pivot axis, and a horizontal-pivot macro-adjustment device, which includes a locking device that, when loosened, allows manual rotation of the pitching head about a vertical pivot axis.

In this embodiment, the pitching machine further includes both a vertical-pivot micro-adjustment device, which includes a knob operatively attached to a reverse-threaded spindle that, when turned, incrementally rotates the pitching head about the first horizontal pivot axis, and a horizontal-pivot micro-adjustment device, which includes a knob operatively attached to a reverse-threaded spindle that, when turned, incrementally rotates the pitching head about the vertical pivot axis.

In any of the embodiments, the pitching machine may also include a head-rotation macro-adjustment device, which includes a locking device that, when loosened, allows manual rotation of the pitching head about a second horizontal pivot axis that is approximately perpendicular to the first horizontal pivot axis, and a head-rotation micro-adjustment device, which includes a knob operatively attached to a reverse-threaded spindle that, when turned, incrementally rotates the pitching head about the second horizontal pivot axis.

The pitching head may be connected to the stand with a support arm. The distance between the first wheel and the opposing surface can be adjusted to accommodate different size balls, such as baseballs as well as softballs. The opposing surface may be on a second wheel. Two independent motors may drive the first wheel and the second wheel, thus providing the capability to vary the speed as well as the type of pitch. The pitching head may be capable of throwing fastballs, drop balls, curve balls, sliders, knuckle balls, breaking balls, fly balls, pop-ups, catcher's pop-ups, line drives, and grounders.

The micro-adjustment features of the pitching machine provide an easy and accurate way to fine-tune the pitch location.

BRIEF DESCRIPTION OF THE DRAWINGS

FIG. 5 is a side view of a universal joint.

FIG. 6 is a partial view of the pitching machine showing vertical-pivot and head-rotation indicators of the pitching machine of FIG. 1.

FIG. 13 is another partial, interior view of the horizontal-pivot micro-adjustment device of the pitching machine of FIG. 1.

FIG. 14 is a perspective view of a pitching machine suitable for softball.

DETAILED DESCRIPTION OF THE INVENTION

Figure 1:
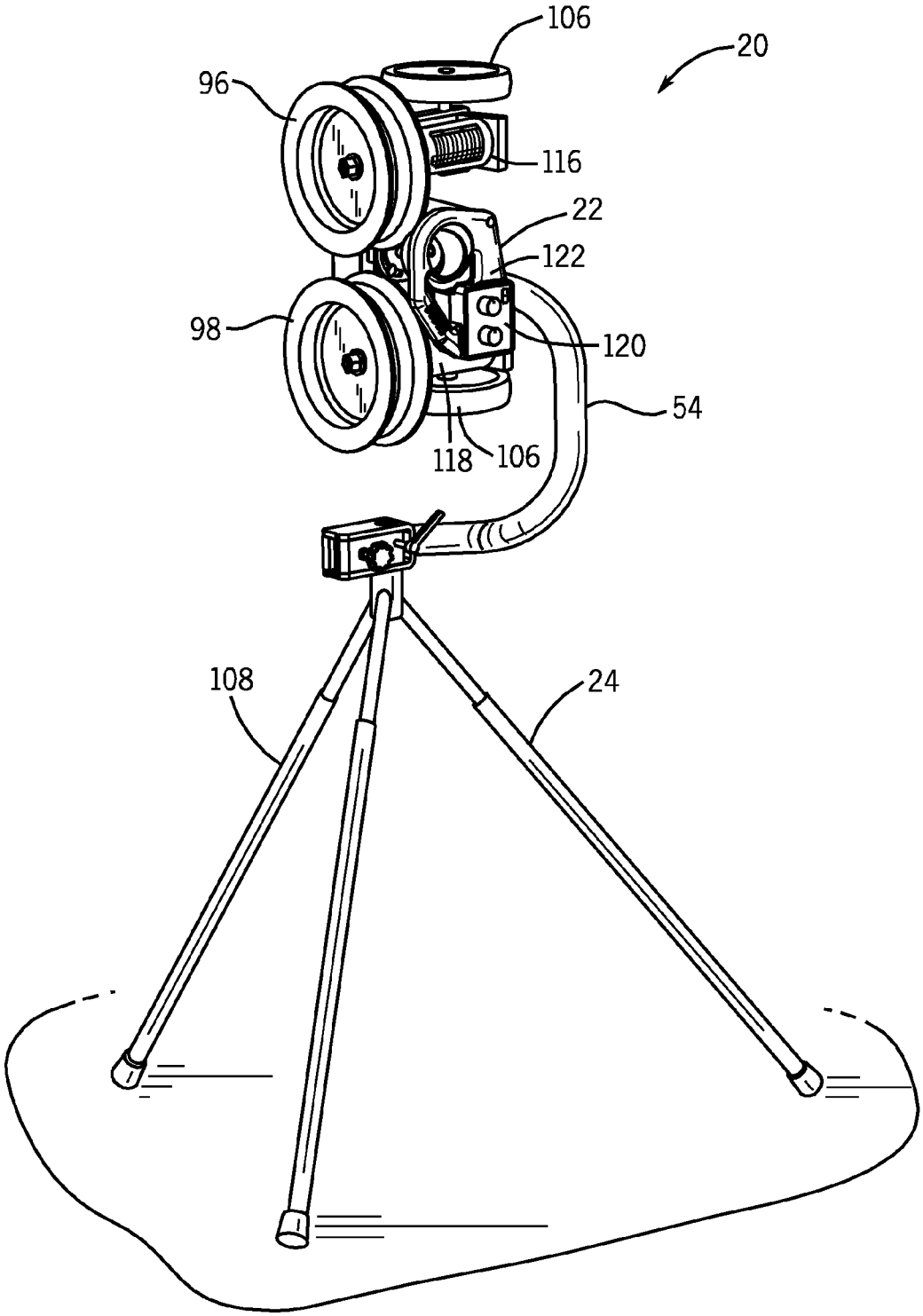
FIG. 1 is a front, first side perspective view of a pitching machine in accordance with a preferred embodiment of the present invention.

Referring to FIG. 1, a pitching machine configured for projecting or pitching a ball is indicated generally at 20. The present invention is described below with respect to a pitched baseball or softball. The present invention is also applicable to the projecting of baseballs or softballs for other purposes, such as to replicate a fly ball, a line drive or a ground ball. Further, the present invention is also applicable to other types of balls, such as, for example, footballs, tennis balls, soccer balls, and volleyballs.

The pitching machine includes a pitching head 22 situated atop of, and coupled to, a pitching stand 24 through a support arm 54. The pitching machine 20 provides macro-adjustment capabilities as well as unique micro-adjustment capabilities for adjusting the pitch location of any pitched balls. The primary points of adjustment include: (1) up and down about a horizontal axis 40 (FIG. 2), (2) left and right about a vertical axis 76 (FIG. 2), and (3) head rotation about a horizontal axis 68 (FIG. 6) positioned substantially parallel with the direction of a projected ball from the pitching machine 20. In alternative embodiments, the pitching machine may have only up/down and left/right adjustability.

Figure 2:
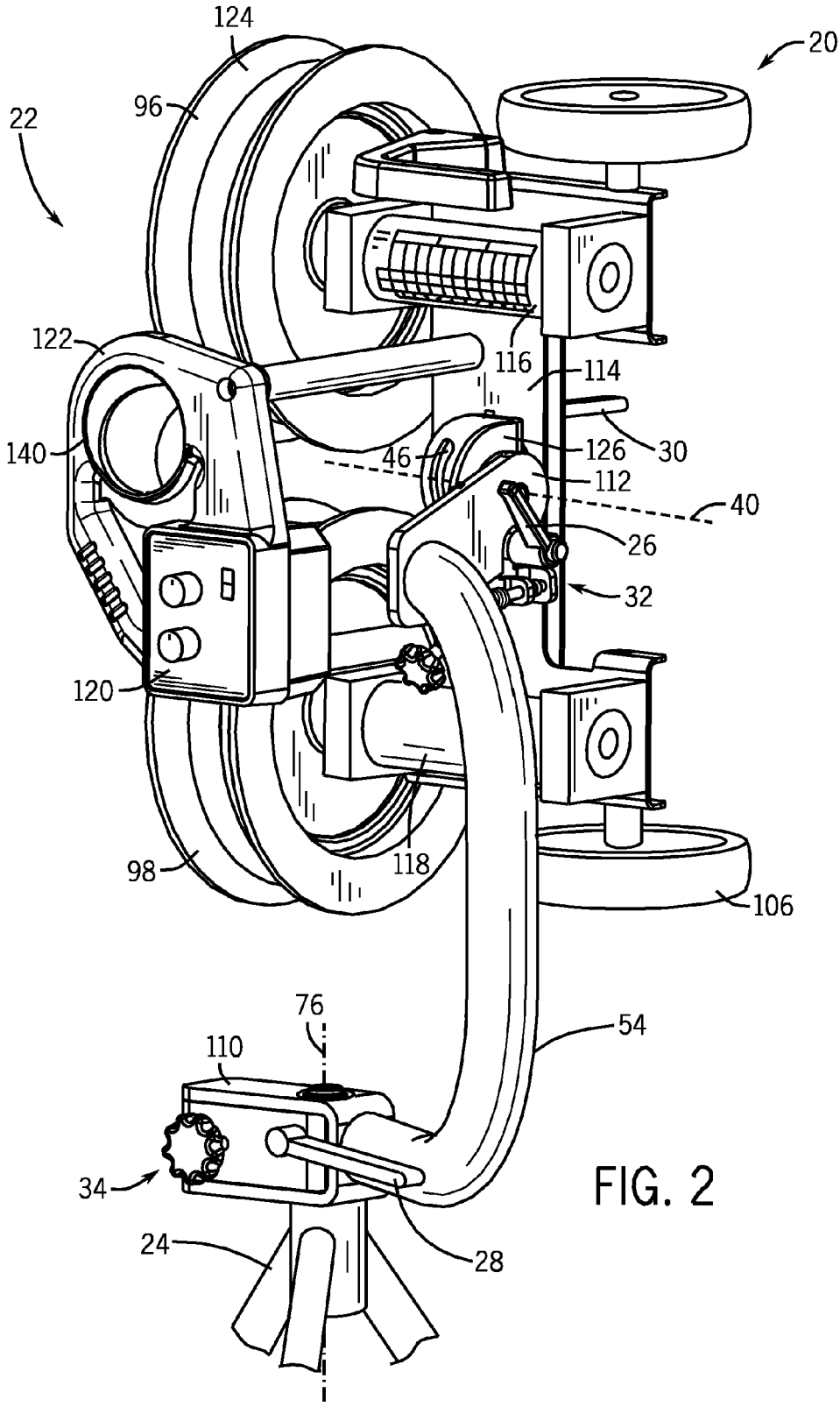
FIG. 2 is front, second side perspective view of the pitching machine of FIG. 1.

Referring to FIGS. 1 and 2, the support arm 54 includes a first support end 110 engaging the stand 24 and a second support end 112 engaging the pitching head 22. The support arm 54 positions the pitching head 22 generally above the stand 24. The support arm 54 provides support to the pitching head 22 without interfering with any of the pitching machine features, such as the vertical-pivot, horizontal-pivot, and head-rotation adjustment devices. In a preferred embodiment the support arm 54 has a shape resembling a C or a U. In alternative embodiments, the shape of the support arm 54 can be semi-circular, semi-rectangular or other curved or angled shapes.

The pitching head 22 includes a main support plate 114 supporting first and second wheels 96 and 98 driven by first and second motors 116 and 118, respectively, a controller 120, a ball outlet housing 122 including a ball outlet 140, a vertical-pivot micro-adjustment device 32 and a horizontal-pivot micro-adjustment device 34. The second end 112 of the support arm 54 is coupled to the main support plate 114. In a preferred embodiment, the second end 112 is connected to the main support plate 114 by a support bracket 126. The support bracket 126 provides an adjustable connection of the support arm 54 to the main support plate 114.

The first and second wheels 96 and 98 are spaced apart from each other by a distance slightly less than a diameter of a ball, such as a baseball, a softball, or pitching machine balls sized to resemble baseballs or softballs. The first and second wheels 96 and 98 are situated closely enough to one another to grip the ball, yet the grip is loose enough to allow the ball to rotate in cooperation with rotation of the first wheel 96. In certain embodiments, the distance between the first and second wheels 96 can be adjusted to accommodate different size balls, such as baseballs as well as softballs, and to impart varying amounts of spin onto the ball.

In an alternative preferred embodiment, the second wheel 98 can be replaced by an opposing surface that may be either stationary or movable. For example, the second wheel can serve as an opposing surface that is not motor driven and rotatable about its axis. Alternatively, the second wheel 98 can rotate at a different or opposite speed than the first wheel 96 thereby providing additional adjustability and ball spin control. One or both of the first and second wheels 96 and 98 preferably can include a concave profile about its periphery 124 to provide additional engagement or contact surface with the ball and to improve the accuracy of the projected ball.

The first and second motors 116 and 118 drive the first and second wheels 96 and 98, respectively. The first and second motors 116 and 118 are connected to the main support plate 114 and operably coupled to the controller 120. The first and second motors 116 and 118 enable a user to independently vary the speed of the first and second wheels 96, 98 provides the pitching machine 20 with exceptional ball control in terms of desired speed and spin.

In a preferred embodiment, the ball outlet 140 is the location where the projected ball exits the pitching machine 20. The direction of the ball passing through the ball outlet 140 is generally parallel to the axis 68 (see FIG. 6) and generally perpendicular to the axis 40 (see FIG. 6).

The macro-adjustment capabilities of the pitching machine 20 may be akin to the adjustment features on conventional pitching machines. More particularly, these macro-adjustments are accomplished by loosening a vertical-pivot locking handle assembly 26, a horizontal-pivot locking handle assembly 28, and/or a head-rotation locking handle assembly 30, and then, moving the pitching head 22 about one or more of these axis points to position the pitching head 22 to throw the type of pitch (or spin angle) to the desired location. After setting the pitching head 22 at the approximate desired location, the user locks the pitching head 22 into position with any one or more of the locking handle assemblies 26, 28, 30 and throws test pitches. If a single person is making the macro-adjustments, the single person typically must use both hands to complete the adjustments effectively. One hand manipulates the locking handle assemblies 26, 28 and 30 and the other keeps the pitching head 22 from rotating, swinging or dropping out of the desired position. Alternatively, two people can make the adjustments.

Figure 3:
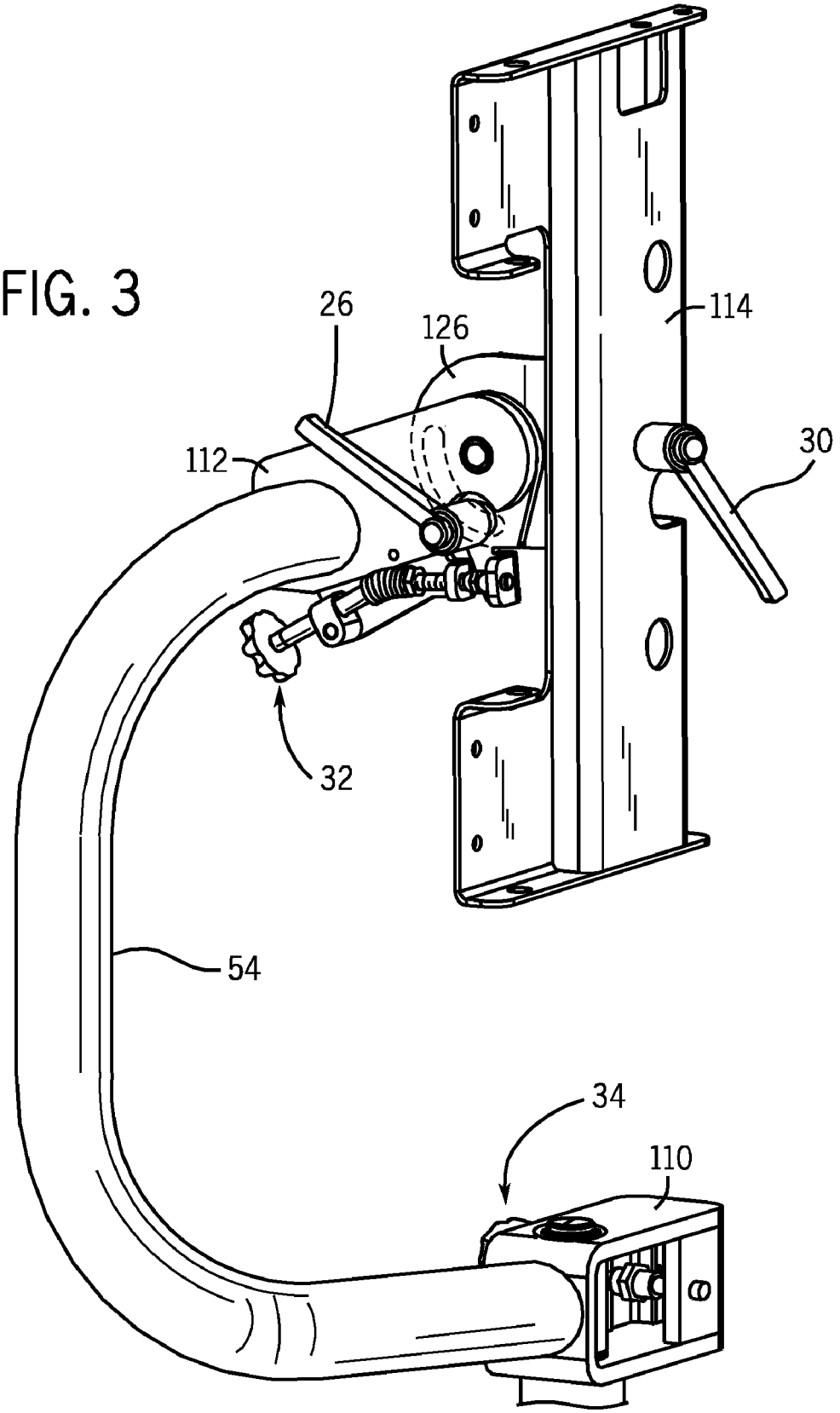
FIG. 3 is a structural diagram of two micro-adjustment features of the pitching machine of FIG. 1.
Figure 7:
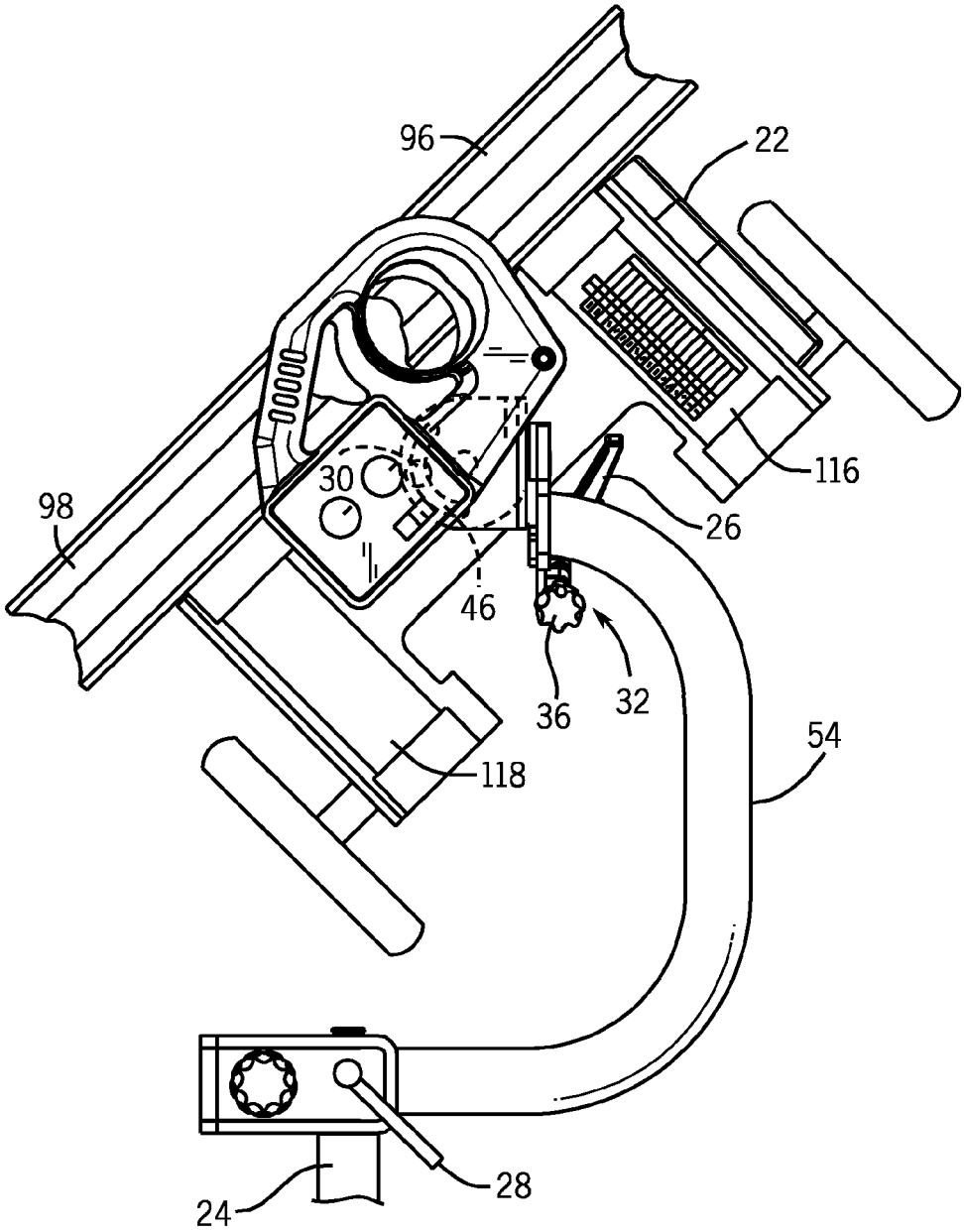
FIG. 7 is a partial front view of the pitching machine of FIG. 1 demonstrating head rotation pitching machine.
Figure 8:
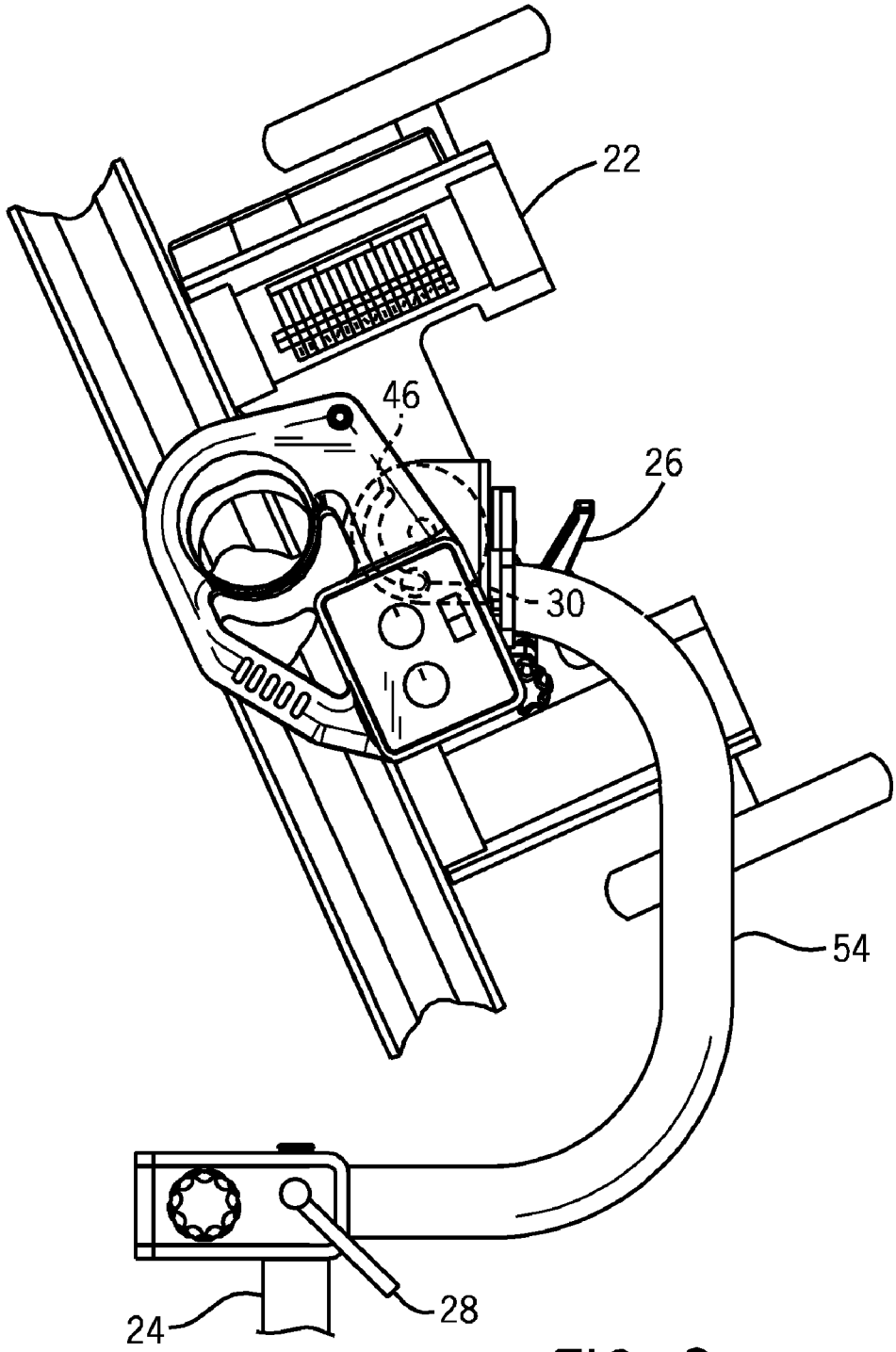
FIG. 8 is another partial front view of the pitching machine demonstrating head rotation pitching machine of FIG. 1.

Referring to FIGS. 2, 3 and 6, the locking handle assemblies 26, 28 and 30 are shown in greater detail. Support bracket 126 includes first and second channels 44 and 46 for engaging the locking handle assemblies 26 and 30, respectively. The locking handle assembly 26 extends through the second end 112 of the support arm 54 and through the first channel 44 of the support bracket 126 to releasably lock the pitching head 22 to the support arm 54 and prevent significant rotation of the pitching head 22 about the horizontal axis 40. The locking handle 30 extends through the main support plate 114 and through the second channel 46 of the support bracket 126 to releasably lock the pitching head 22 to the support arm 54 and prevent significant rotation of the pitching head 22 about the horizontal axis 68. Referring to FIGS. 7 and 8, two different locations of the pitching head 22 about the horizontal axis 68 (FIG. 6) are shown. Rotation of pitching head 22 about axis 68 provides further adjustability to the user and enables the machine 20 to pitch curve balls and other types of pitches in specific targeted locations. The locking handle assembly 28 extends through the first end 110 of the support arm 54 and through the stand 24 to releasably lock the stand to the support arm 54 and to prevent significant rotation of the support arm 54 and the pitching head 22 about the vertical axis 76.

After pitching a test pitch, a user of a pitching machine will often desire to make additional minor or micro adjustments to fine-tune or pinpoint the position or location of the pitched ball. Typically, a user will desire to move the location of the pitched ball to the left or right, or up or down. The micro-adjustment capabilities of the present pitching machine 20 allows for precise and accurate minor adjustments to made in a quick and easy manner. Rather than continuously loosening a locking handle, manually moving the pitching head 22, and re-locking the pitching head 22 into position, the micro-adjustment capabilities enables a user to fine-tune the pitch location with a simple turn of one or more micro-adjustment knobs.

Figure 4:
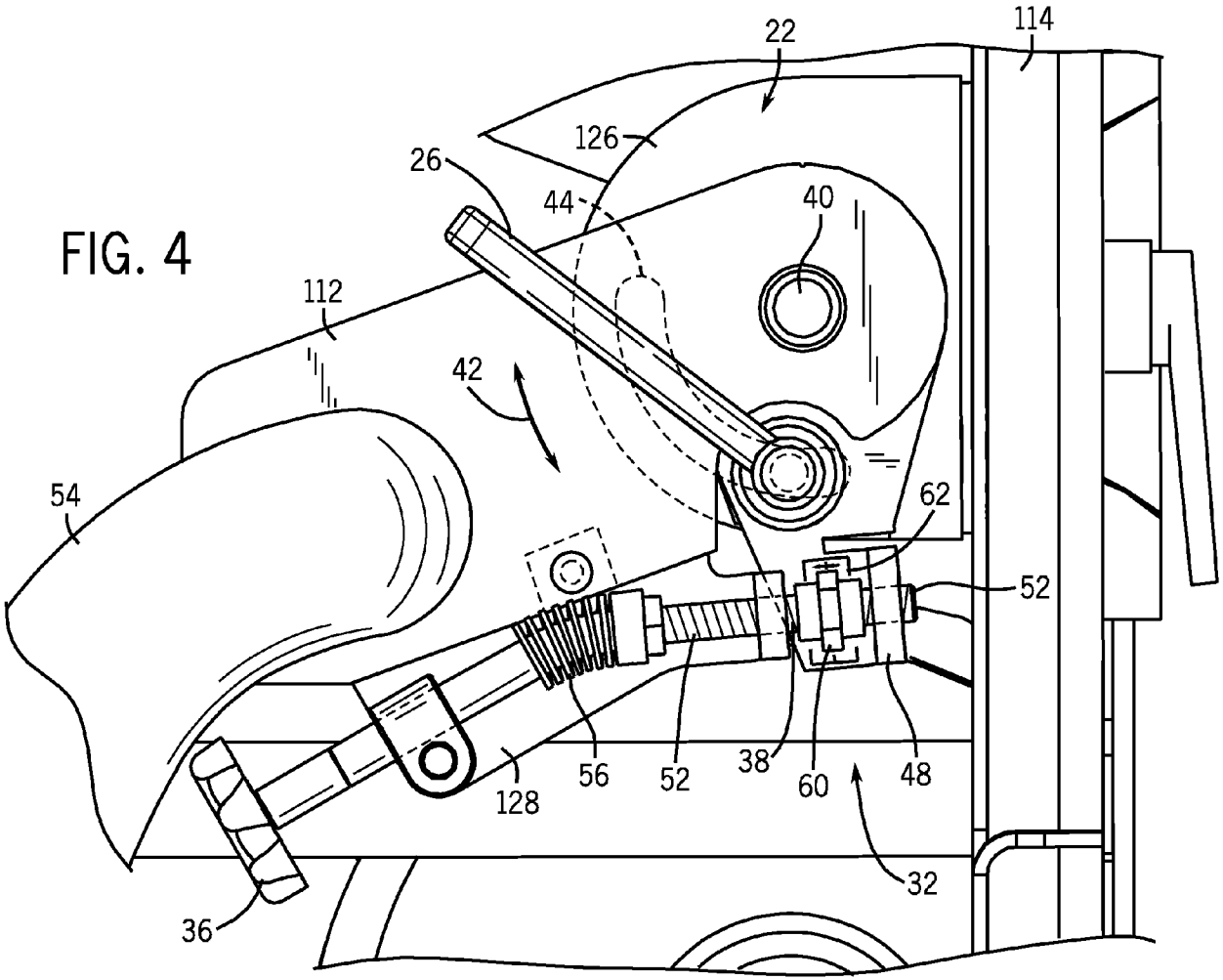
FIG. 4 is a partial view of a vertical-pivot micro-adjustment device of the pitching machine of FIG. 1.

FIG. 3 illustrates the location of a vertical-pivot micro-adjustment device 32 and a horizontal-pivot micro-adjustment device 34. Referring to FIG. 4, the vertical-pivot micro-adjustment device 32 is shown in greater detail. The vertical-pivot micro-adjustment device 32 allows fine-tuning of the pitch location by allowing slight controlled rotation of the pitching head 22 about the horizontal axis 40 (shown perpendicular to the plane of FIG. 4) thereby adjusting the location of the pitched ball exiting the pitching head 22 either up or down. The vertical-pivot micro-adjustment device 32 is attached to the second end 114 of the support 54 through first pivot bracket 128 and to the pitching head 22 through second pivot bracket 48. The vertical-pivot micro-adjustment device 32 includes a micro-adjustment knob 36 operatively attached to a reverse-threaded spindle 38 that, when turned, incrementally rotates the pitching head 22 about a horizontal axis 40. Arrow 42 demonstrates the direction of movement of the pitching head 22.

Figure 4A:
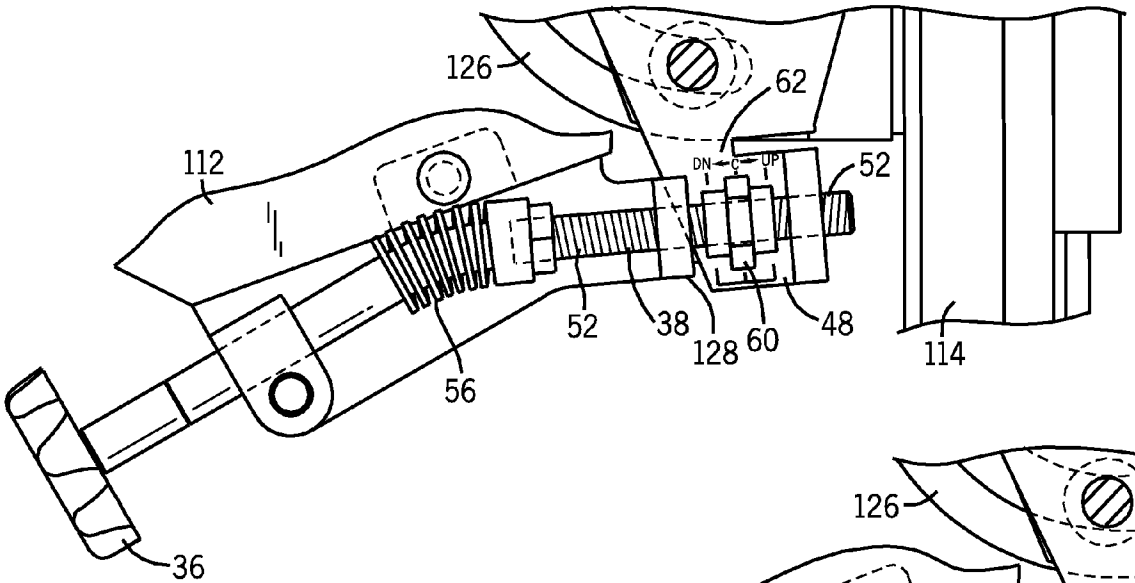
FIGS. 4A and 4B are partial views of the vertical-pivot micro-adjustment device illustrated in FIG. 4.
Figure 4B:
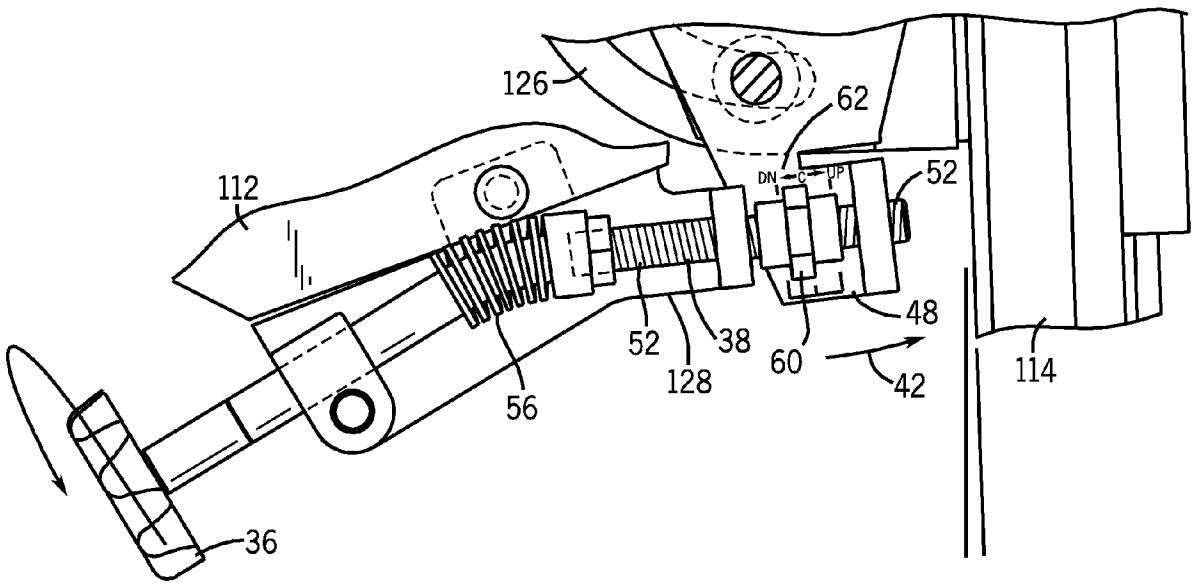

The reverse-threaded spindle 38 is a machined stainless-steel round bar that is threaded on both ends. As shown in FIGS. 4A and 4B, the spindle 38 is positioned in first and second pivoting brackets 128 and 48 and/or through pivoting bushings such that, when the micro-adjustment knob 36 is turned, the spindle 38 moves the pitching head 22 either up or down in an accurate, controlled manner. Rotation of the micro-adjustment knob 36 causes the first and second pivot brackets 128 and 48 to be drawn either closer to, or further from, each other creating an upward, or downward, movement of the outlet of the pitching head 22. The threads 52 on both ends of the spindle 38 are opposing or opposite of each other. Since the threads 52 are opposed, it is not necessary to manually lock the spindle 38 after making a micro-adjustment. The threads 52 create opposing pressure. Thus, in a sense, the threads 52 are working against each other, which does not allow the spindle 38 to turn any further without the knob 36 being turned. Therefore, the knob 36 and the pitching head 22 remain fixed when the user releases the knob 36 following an adjustment. The force created by manually turning the knob 36 overrides the ambient pressure, thus allowing for the spindle 38 to turn. Accordingly, no relocking of the pitching head 22 is required following micro-adjustment of the pitching head. Under the present invention, the pitching head 22 remains securely positioned, and the user simply rotates the micro-adjustment knob 36 the desired amount, with one hand. No loosening or retightening of adjustment mechanisms is required.

In certain embodiments, as shown in FIGS. 2 and 4, due to the angle and relationship of the pitching head 22 to the support arm 54 extending from the pitching head 22, it may be necessary to use a universal joint 56 to angle the knob 36 position to a convenient and reachable location for the user. An example of one such universal joint 56 is illustrated in FIG. 5. As illustrated, the universal joint 56 includes a spiral-cut section 58 that provides flexibility to accommodate a curved relationship between the knob 36 and the spindle 38. As the knob 36 is turned, the spiral-cut section 58 of the universal joint 56 flexes and turns while simultaneously rotating the spindle 38.

Referring to FIGS. 4A and 4B, the reverse-threaded spindle 38 may include an indicator 60 or index of the spindle location, suitably in the center of the spindle 38. The indicator 60 may be hexagonal in shape, which may also be used for assembly with an open-ended wrench. In alternative embodiments, other indicator devices can be used. A label 62 may be placed on the bracket 48 behind the spindle 38 to allow the user to determine if the indicator 60 is in the center or near the ends of the micro-adjustment range. If the indicator 60 is at or near one of the ends of the micro-adjustment range, the user may need to re-adjust the vertical-pivot macro-adjustment device, or locking handle assembly 26, prior to any further fine-tuning of the vertical-pivot micro-adjustment device 32.

The vertical-pivot micro-adjustment range of a pitched ball to a target may be quite large, such as up to about 30 inches, or up to about 36 inches. For example, 1.5 turns of the vertical-pivot micro-adjustment knob 36 may equate to a 36-inch vertical span in the strike field. The micro-adjustments are limited primarily to the field of a strike zone. The vertical pivot micro-adjustment device 32 allows a user to easily and efficiently perform minor or micro-adjustments of the pitching machine 20 with a single hand through simply rotating the micro-adjustment knob 36. The macro-adjustment device or first locking handle assembly 26 retains the pitching head in a secure position during micro-adjustment. Accordingly, the user does not have to use his or her other hand, or require the assistance of a second person, to support the weight of the pitching head 22 while micro-adjustments are made.

A visible indicator 64 for positioning the pitching head 22 with the vertical-pivot macro-adjustment device, or first locking handle assembly 26, is illustrated in FIG. 6. A visible indicator 66 for positioning the pitching head 22 with the head-rotation macro-adjustment device, or locking handle 30, is also illustrated in FIG. 6. One or both of these indicators 64, 66 may provide a pitch location, or delivery point, that can be replicated. For example, a coach may run many different routines or drills with this machine 20, many of which require different delivery points. The delivery points may change from drill to drill, which requires movement of the pitching head 22 back and forth to different positions. By providing visible indicators 64, 66 for positioning the pitching head 22, the coach can go back quickly to a drill by referring to previously established alphanumeric marks, or other form of position marking, of the pitching head 22. These indicators 64, 66 are for macro-adjusting the machine 20; micro-adjustments can be made following the macro-adjustments.

As described above, the vertical-pivot macro- and micro-adjustments move the aim of the pitching head 22 up and down about horizontal axis 40. The horizontal-pivot vertical axis 76. The head-rotation macro- and micro-adjustments can simultaneously move the aim of the pitching head 22 both up or down and left or right. Referring to FIGS. 6-8, movement of locking handle assembly 30 along the second channel 46 of the support bracket 126 allows the user to move the pitching head 22 about axis 68 further facilitation pitch location including curve ball locations.

Figure 9:
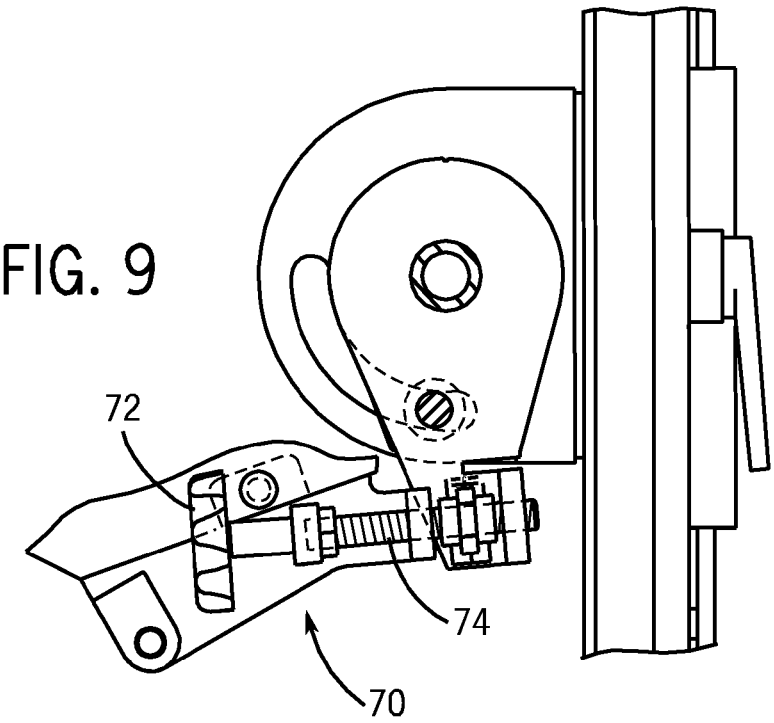
FIGS. 9 and 10 are partial views of the head-rotation micro-adjustment device pitching machine in accordance with another preferred embodiment of the present invention.
Figure 10:
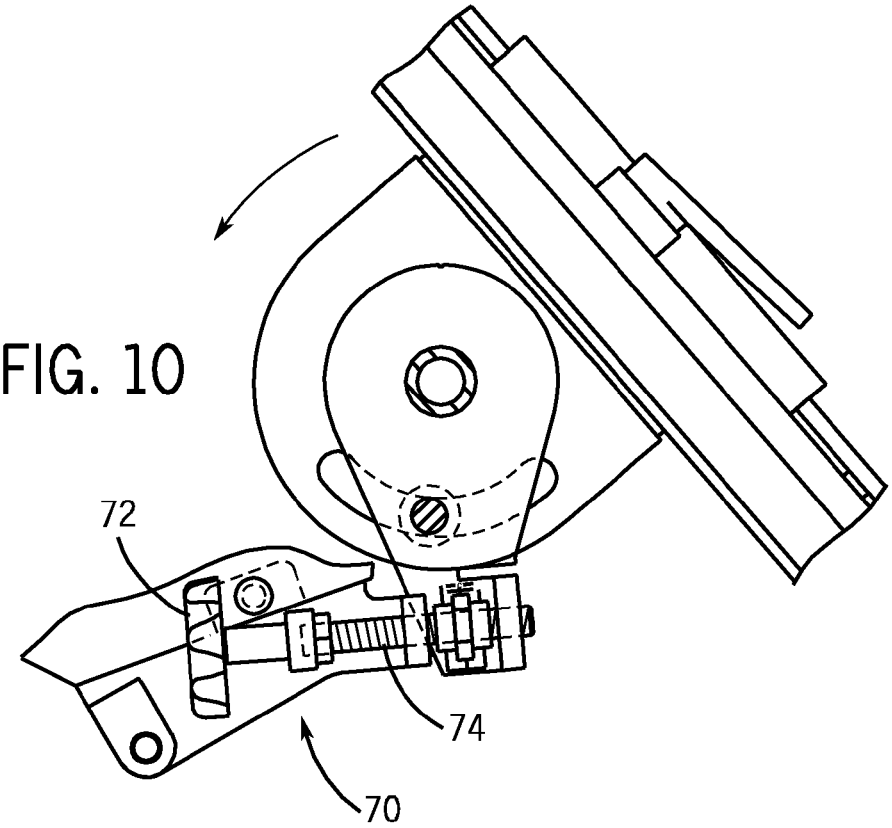

Similar to the vertical-pivot macro-adjustment device, or locking handle assembly 26, the head-rotation macro-adjustment device, or locking handle assembly 30 allows manual rotation of the pitching head 22 about a second horizontal pivot axis 68 that is approximately perpendicular to the horizontal pivot axis 40 about which the vertical-pivot macro- and micro-adjustments rotate. In a preferred embodiment, similar to the vertical-pivot micro-adjustment device 32, a head-rotation micro-adjustment device 70 includes a knob 72 operatively attached to a reverse-threaded spindle 74 that, when turned, incrementally rotates the pitching head 22 about the second horizontal pivot axis 68. FIGS. 9 and 10 illustrate the head-rotation micro-adjustment device 70. Like the vertical-pivot micro-adjustment described above, no relocking of the pitching head 22 is required following micro-adjustment of the pitching head. Under the present invention, the macro-adjustment device or locking handle assembly 30 retains the pitching head in a secure position during micro-adjustment. Therefore, the pitching head 22 remains securely positioned, and the user simply rotates the micro-adjustment knob 72 the desired amount, with one hand. No loosening or retightening of adjustment mechanisms is required.

Figure 11:
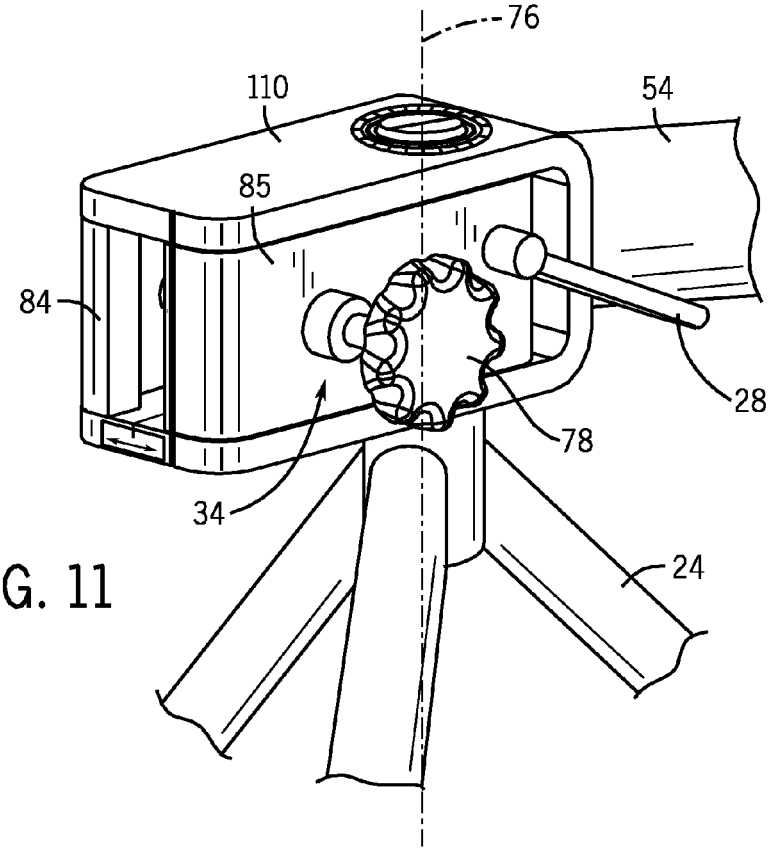
FIG. 11 is a partial front perspective view of a horizontal-pivot micro-adjustment device pitching machine of the pitching machine of FIG. 1.

FIG. 11 illustrates the horizontal-pivot macro-adjustment device or locking handle assembly 28 and the horizontal-pivot micro-adjustment device 34. Both of these horizontal-pivot adjustment devices allow left-right adjustment to the aim of the pitching head 22. Like the vertical-pivot macro-adjustment device (locking handle assembly 26) and the head-rotation macro-adjustment device (locking handle assembly 30), the horizontal-pivot macro-adjustment device (locking handle assembly 28) that releasably locks the support arm 54 and the pitching head 22 to the stand 24 and prevents significant rotation of the support arm 54 with respect to the stand 24 about the vertical axis 76.

Figure 12:
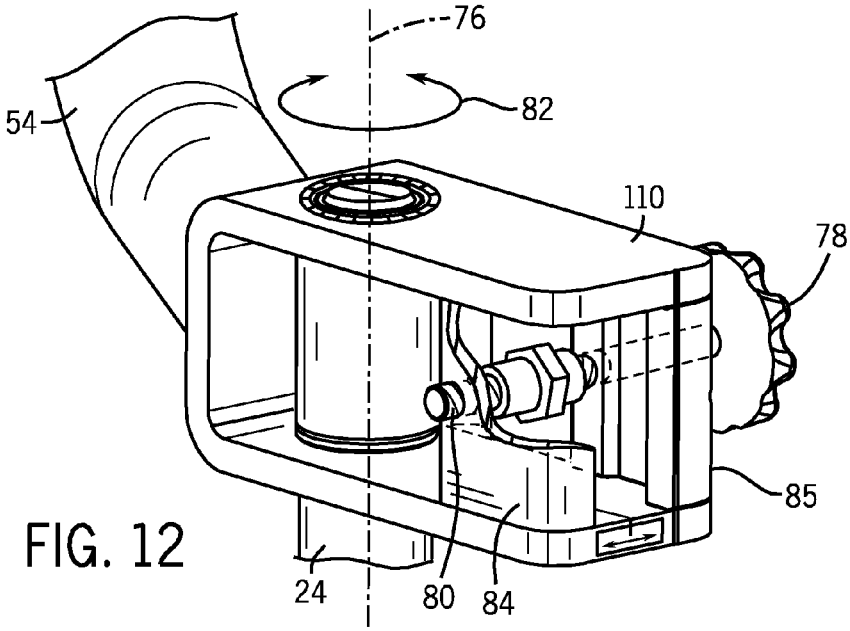
FIG. 12 is a rear interior perspective view of the horizontal-pivot micro-adjustment device of the pitching machine of FIG. 1.

The horizontal-pivot micro-adjustment device 34 allows fine-tuning of the pitch location by moving the pitching head 22 in small increments to adjust the pitch to either the left or the right. Similar to the other micro-adjustment devices, the horizontal-pivot micro-adjustment device 34 includes a micro-adjustment knob 78 operatively attached to a reverse-threaded spindle 80 that, when turned, incrementally rotates the pitching head 22 about the vertical pivot axis 76, as illustrated in FIG. 12. Arrow 82 demonstrates the direction of movement of the pitching head 22. As in the vertical-pivot micro-adjustment device 32, the reverse-threaded spindle 80 can be positioned between third and fourth pivoting brackets 84 and 85 and/or through a pivoting bushing such that, when the knob 78 is turned, the spindle 80 moves the pitching head 22 either to the left or to the right. The third pivot bracket 84 is fixed to the first end 110 of the support arm 54, and the fourth pivot bracket 85 is fixed to the stand 24.

Referring to FIGS. 11-13, rotation the micro-adjustment knob 78 causes the third and fourth pivot brackets 84 and 85 to be drawn either closer to, or further from, each other creating a left, or right, movement of the outlet of the pitching head 22. Therefore, movement of the adjustment knob 78 causes the support arm 54 to rotate with respect to the stand 24 about axis 76. As explained above, the reverse threading of the spindle 80 creates opposing pressure, which obviates the need for manual locking of the knob 78, while the force created by manually turning the knob 78 overrides the ambient pressure, thus allowing for the spindle 80 to turn only when desired. The present invention enables a user to move the micro-adjustment knob 78 with a single hand and relocate the position of the pitching head to the fine-tuned, desired position. Under the present invention, the pitching head 22 remains securely positioned, and the user simply rotates the micro-adjustment knob 78 the desired amount, with one hand. No loosening or retightening of adjustment mechanisms is required.

The reverse-threaded spindle 80 may include an indicator 88 or index of the spindle location, as shown in FIG. 13. The indicator 88 may be hexagonal, or any other suitable shape. A label 90 may be placed on the bracket 84 near the spindle 80 to allow the user to determine if the indicator 88 is in the center or near one of the ends of the micro-adjustment range. Thus, if the indicator 88 is at or near one of the ends of the micro-adjustment range and the desired position is still not achieved, the user can determine whether it is necessary to re-adjust the macro-adjustment device (locking handle 28) prior to any further micro-adjustments in order to achieve the desired position of the pitching head 22.

Additionally, a visible left-right indicator label 92 may be present on the bracket 84 to establish a desired pitch location that can be replicated. More particularly, the left-right indicator 92 can be used in combination with a scored line 94 or other marker on a portion of the pitching stand 24 extending through the bracket 84, such that when the desired left-right pitch location is achieved, the user notes the location of the scored line 94 with respect to the corresponding letter or number or other indicia on the left-right indicator label 92. Consequently, the user may adjust the pitching head 22 to other directions and may return to a desired pitch location at any time simply by using the horizontal-pivot macro-adjustment device (locking handle assembly) 28 to re-align the scored line 94 with the left-right indicator label 92 and, if necessary, subsequently using the horizontal-pivot micro-adjustment device 34 to fine-tune the pitch location.

As mentioned above, a coach may run many different routines or drills with this machine 20, many of which require different delivery points. The delivery points may change from drill to drill, which requires movement of the pitching head 22 back and forth to different positions. By providing visible indicators for positioning the pitching head 22, the coach can go back quickly to a drill by knowing the alphanumeric or other marked position of the pitching head 22.

The horizontal-pivot micro-adjustment range may be up to about 18 inches, or up to about 24 inches, for example. Adjusting the aim of the pitching head 22 from one end of the horizontal span of the field of a strike zone to the other may be accomplished in just 1.5 turns of the horizontal-pivot micro-adjustment knob 78, more or less. In a preferred embodiment, like the vertical-pivot micro-adjustments, the horizontal-pivot micro-adjustments can be primarily limited to the strike field. In other embodiments, other operational micro-adjustment ranges can be used.

The above-described features of the pitching machine 20 provide an easy and accurate way to fine-tune the pitch location without the need to continually loosen and tighten the machine 20. The pitching machine 20, according to the invention, may include one or more of the micro-adjustment features, namely the vertical-pivot micro-adjustment device 32, the horizontal-pivot micro-adjustment device 34, and/or the head-rotation micro-adjustment device 70. The pitching machine of the present invention allows for micro-adjustments of the pitching machine to be made by a user with one hand. The user simply repositions one of the micro-adjustment knobs. Unlike existing pitching machines that require the user to support the pitching head during minor adjustments, the present invention maintains the pitching head 22 in a secure and supported position during the micro-adjustments. The macro-adjustment device or locking handle assembly 28 retains the pitching head in a secure position during micro-adjustment. Accordingly, the need for the user to hold and retain the heavy pitching head during minor or micro-adjustments is eliminated. The present invention allows for safe and efficient micro-adjustments of the pitching machine.

For the most part, the aforementioned parts of the pitching machine 20 can be used as additions to existing product designs with some minor modifications to the current parts. In general, the pitching machine 20 includes the pitching head 22 situated atop the stand 24, which may include a tripod. Additional modifications to the design may be performed to accommodate different types of balls. For example, the pitching head 22 may be situated atop a much shorter stand 102, as shown in FIG. 14, for pitching softballs compared to a taller stand 24, as shown in FIG. 1, for pitching baseballs. In certain embodiments, a laser may be affixed to the pitching head 22 to project a laser-beam at the target pitch location, thus allowing a user to see where the ball will hit prior to the actual pitch.

Figure 15:
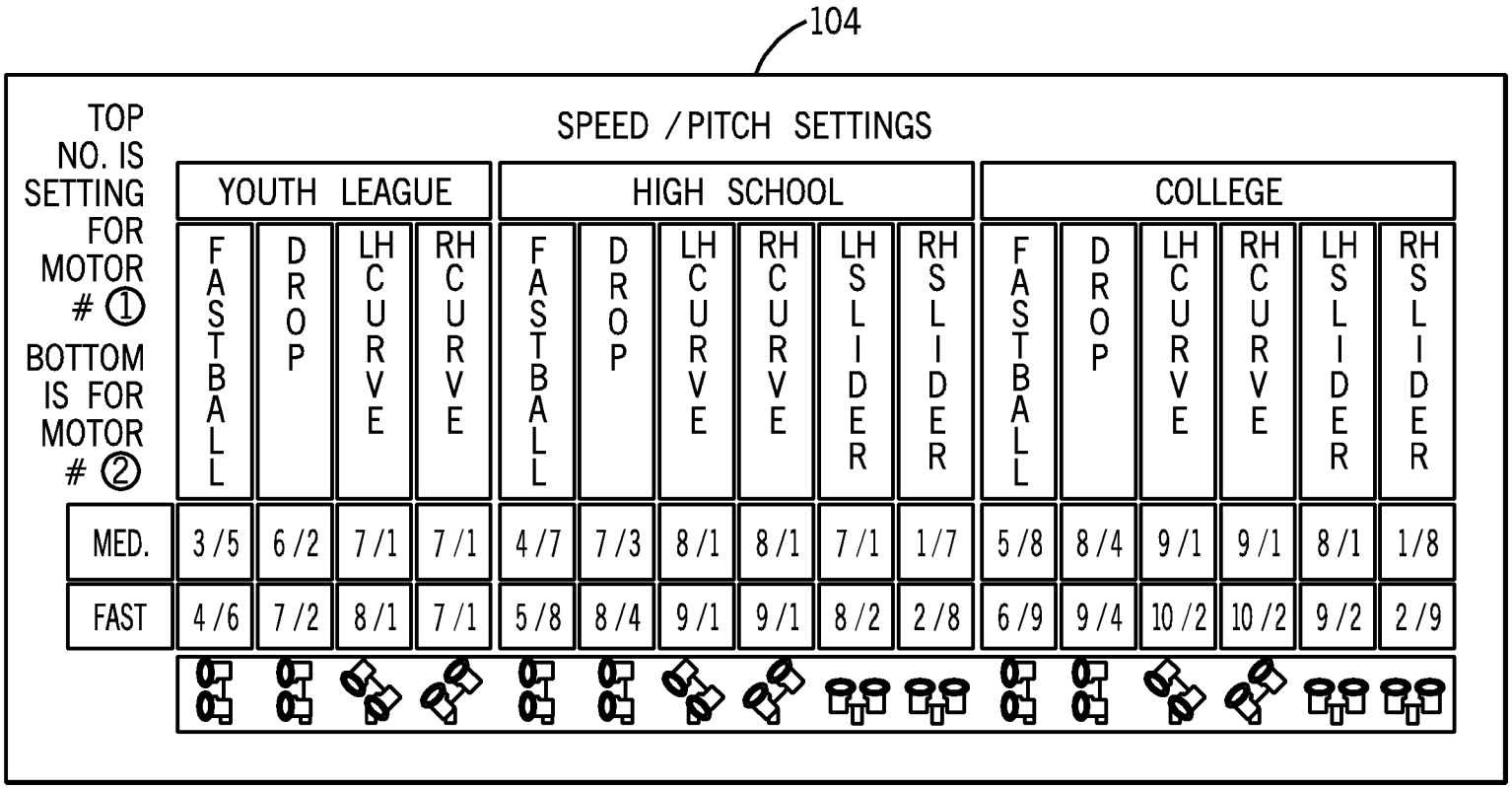
FIG. 15 is a diagram of a pitch selection and speed chart.

The pitching machine 20 may include a pitch selection and speed chart 104, such as the one illustrated in FIG. 15. As shown in FIG. 15, a variety of types of pitches can be achieved by varying the speed of the first and second motors, as indicated in the rows labeled "Med." and "Fast," and positioning the pitching head 22 as shown along the bottom of the chart 104. Examples of types of pitches that can be thrown by the pitching machine 20 include fastballs, drop balls, left-handed curve balls, right-handed curve balls, left-handed sliders, right-handed sliders, knuckle balls, breaking balls, fly balls, pop-ups, catcher's pop-ups, line drives, and grounders. As known by those skilled in the art, the projection of a ball changes with speed. The design of this pitching machine 20 can provide accurate pitches at variable speeds, ranging from about 30 to about 100 miles per hour (mph).

As illustrated in FIGS. 1 and 2, the pitching machine 20 can include a set of built-in transport wheels 106 for easy mobility. Quick-release legs 108 on the tripod stand 24 may further facilitate transportation of the pitching machine 20. These quick-release legs 108 may telescopically extend and retract to create a more compact design when moving or storing the pitching machine 20. Additionally, the various parts of the pitching machine 20 may be modular so that individual parts can be removed easily in case any of the parts need to be serviced in the field by the user.

While the preferred embodiments of the invention have been illustrated and described, it will be appreciated that various changes can be made therein without departing from the spirit and scope of the invention. For example, while the embodiments described herein are illustrated in a pitching machine for pitching baseballs, the principles of the present invention could also be used for pitching machines for pitching practically any other type of ball. Accordingly, it will be intended to include all such alternatives, modifications and variations set forth within the spirit and scope of the appended claims.

What is claimed is:

1. A pitching machine configured for micro-adjustment by a single hand of a user, the pitching machine comprising:

a pitching head situated atop a stand, the pitching head including a first wheel spaced apart from an opposing surface by a distance slightly less than a diameter of a ball, and a first motor for driving the first wheel;

a first macro-adjustment device coupled to the pitching head and including a first locking assembly that, when loosened, allows manual rotation of the pitching head about a first pivot axis; and a first micro-adjustment device coupled to the pitching head, the first micro-adjustment device including a first adjusting element that, when repositioned, incrementally rotates the pitching head about the first pivot axis irrespective of whether the first macro-adjustment device in loosened or unloosened, the first micro-adjustment device configured for operation by the single hand of a user, the first macro-adjustment device when tightened retaining the pitching head in a secure position with respect to the first axis during adjustment of the first micro-adjustment device.

2. The pitching machine of claim 1, wherein the first micro-adjustment device includes a first reverse-threaded spindle, and wherein the first reverse-threaded spindle comprises a first position indicator.

3. The pitching machine of claim 1, wherein the first micro-adjustment device includes a first reverse-threaded spindle, and wherein the first micro-adjustment device further comprising a first universal joint that connects the spindle to the first adjusting element.

4. The pitching machine of claim 1, further comprising a first visible indicator for positioning the pitching head with the first macro-adjustment device.

5. The pitching machine of claim 1, wherein the first micro-adjustment device has a range up to at least 36 inches.

6. The pitching machine of claim 1, wherein the opposing surface is a second wheel, wherein pitching machine further comprises a second motor for driving the second wheel, and wherein the second motor is independent of the first motor.

7. The pitching machine of claim 1, wherein the distance between the first wheel and the opposing surface can be adjusted to accommodate different size balls.

8. The pitching machine of claim 1, wherein the first pivot axis is a first substantially horizontal axis.

9. The pitching machine of claim 1, further comprising a second macro-adjustment device coupled to the pitching head and including a second locking assembly that, when loosened, allows manual rotation of the pitching head about a second pivot axis.

10. The pitching machine of claim 9, further comprising a second micro-adjustment device coupled to the pitching head, wherein the second micro-adjustment device including a second adjusting element that, when repositioned, incrementally rotates the pitching head about the second pivot axis, wherein the second micro-adjustment device configured for operation by a single hand of the user, and wherein the second macro-adjustment device retains the pitching head in a secure position during adjustment of the second micro-adjustment device.

11. The pitching machine of claim 9, wherein the second pivot axis is a generally vertical axis.

12. The pitching machine of claim 10, wherein the second micro-adjustment device includes a second reverse-threaded spindle.

13. The pitching machine of claim 12, wherein the second micro-adjustment device further comprising a second universal joint that connects the second spindle to the second adjusting element.

14. The pitching machine of claim 10, wherein the second micro-adjustment device has a range up to at least 24 inches.

15. The pitching machine of claim 9, further comprising a second visible indicator for positioning the pitching head with the second macro-adjustment device.

16. A pitching machine configured for micro-adjustment by a single hand of a user, the pitching machine comprising:

a pitching head situated atop a stand, the pitching head including a first wheel spaced apart from an opposing surface by a distance slightly less than a diameter of a ball, and a first motor for driving the first wheel;

a first macro-adjustment device coupled to the pitching head and including a first locking assembly that, when loosened, allows manual rotation of the pitching head about a first pivot axis; and a first micro-adjustment device coupled to the pitching head, the first micro-adjustment device including a first adjusting element that, when repositioned, incrementally rotates the pitching head about the first pivot axis, the first micro-adjustment device configured for operation by the single hand of the user, the first macro-adjustment device retaining the pitching head in a secure position during adjustment of the first micro-adjustment device;

a second macro-adjustment device coupled to the pitching head and including a second locking assembly that, when loosened, allows manual rotation of the pitching head about a second pivot axis; and a third macro-adjustment device coupled to the pitching head and including a third locking assembly that, when loosened, allows manual rotation of the pitching head about a third pivot axis.

17. The pitching machine of claim 16, further comprising a third micro-adjustment device coupled to the pitching head, wherein the third micro-adjustment device including a third adjusting element that, when repositioned, incrementally rotates the pitching head about the third pivot axis, wherein the third micro-adjustment device configured for operation by a single hand of a user, and wherein the third macro-adjustment device retains the pitching head in a secure position during adjustment of the third micro-adjustment device.

18. The pitching machine of claim 16, wherein the third pivot axis is a generally horizontal axis positioned generally perpendicular to the first pivot axis.

19. The pitching machine of claim 17, wherein the third micro-adjustment device includes a third reverse-threaded spindle.

20. A pitching machine configured for adjustment by a user, the pitching machine comprising:

a pitching head situated atop a stand, the pitching head including a first wheel spaced apart from an opposing surface by a distance slightly less than a diameter of a ball, and a first motor for driving the first wheel;

a first macro-adjustment device coupled to the pitching head configured for adjustable manual rotation of the pitching head about a first pivot axis; and a first micro-adjustment device coupled to the pitching head, the first micro-adjustment device including a first adjusting element that, when repositioned, incrementally rotates the pitching head about the first pivot axis, and a first reverse-threaded spindle coupled to the pitching head.

21. The pitching machine of claim 20, wherein the first reverse-threaded spindle comprises a first position indicator.

22. The pitching machine of claim 20, wherein the first micro-adjustment device further comprises a first universal joint that connects the spindle to a first adjusting element.

* * * * *